US006055399A

United States Patent [19]

Omura

[11] Patent Number: 6,055,399

[45] Date of Patent: Apr. 25, 2000

[54] IMAGE FORMING APPARATUS

[75] Inventor: Kinya Omura, Kashiwa, Japan

[73] Assignee: Canon Kabushiki Kaisha, Tokyo, Japan

[21] Appl. No.: 09/083,246

[22] Filed: May 21, 1998

[30] Foreign Application Priority Data

May 27, 1997 [JP] Japan ..... 9-136883

[51] Int. Cl.[7] ..... G03G 15/00

[52] U.S. Cl. ..... 399/167; 399/297

[58] Field of Search ..... 399/159, 167, 399/297, 298, 302, 303, 308, 312

[56] References Cited

U.S. PATENT DOCUMENTS

| | | | |
|---|---|---|---|
| 5,136,332 | 8/1992 | Johnson | 399/303 |
| 5,170,209 | 12/1992 | Tompkins et al. | 399/167 X |
| 5,202,733 | 4/1993 | Hediger et al. | 399/303 |
| 5,390,010 | 2/1995 | Yamahata et al. | 399/308 |
| 5,420,664 | 5/1995 | Miwa et al. | 399/167 |
| 5,689,764 | 11/1997 | Fujuchi et al. | 399/167 X |
| 5,708,933 | 1/1998 | Nogami et al. | 399/167 |

*Primary Examiner*—Sandra Brase
*Attorney, Agent, or Firm*—Fitzpatrick, Cella, Harper & Scinto

[57] ABSTRACT

An image forming apparatus capable of preventing disturbance in an image formed on an image bearing member, and a failure in image transfer is provided. In the image forming apparatus, an image bearing member and an intermediate transfer member to which a driving force from a motor is independently transmitted via a gear train (gear portions, driving gears, an idler gear and a gear) are brought in pressure contact with each other at a transfer nip portion. A dynamic damper is provided on the shaft of the motor. According to the present invention, since the amplification of vibration due to the resonance of the motor is suppressed by the damping effect of the dynamic damper, it is possible to suppress the vibration of the image bearing member and the intermediate transfer member, and to prevent disturbance in a latent image formed on the surface of the image bearing member, and a failure in image transfer from the image bearing member to the intermediate transfer member, and from the intermediate transfer member to a transfer material.

12 Claims, 5 Drawing Sheets

IMAGE FORMING APPARATUS

BACKGROUND OF THE INVENTION

1. Field of the Invention

The present invention relates to an image forming apparatus, such as a copier, a printer or the like, which adopts an electrophotographic method or an electrostatic recording method.

2. Description of the Related Art

A description will now be provided of a color laser printer as a conventional image forming apparatus with reference to FIG. 6.

FIG. 6 is a cross-sectional view of a conventional color laser printer. In FIG. 6, reference numeral 104*a* represents an image bearing member. A charging roller 104*b* serves as a primary charger in pressure contact with the image bearing member 104*a*. By applying a voltage to the charging roller 104*b*, the surface of the image bearing member 104*a* is uniformly charged before forming a latent image.

Exposure in the image bearing member 104*a* is performed by a scanner unit 110*a* which includes a laser diode. The laser diode emits light in accordance with an image signal, and projects a laser beam onto a polygonal mirror (not shown). The polygonal mirror is rotated at a high speed by a scanner motor (not shown) to reflect the laser beam. The laser beam reflected by the polygonal mirror selectively exposes the external circumferential surface of the image bearing member 104*a* after passing through a combined lens 110*b* and a reflecting mirror 110*c*. As a result, an electrostatic latent image is formed on the image bearing member 104*a* by the exposure of the laser beam.

The electrostatic latent image is developed by a rotating developing device 105 to provide a toner image of each color toner. The rotating developing device 105 includes developing units 105M, 105C, 105Y and 105K for a plurality of colors, i.e., magenta, cyan, yellow and black, respectively. The developing units 105M, 105C, 105Y and 105K for the four colors are disposed so as to be rotatable around a central axis 105*e* of the rotating developing device 105. The center of each of the developing units 105M, 105C, 105Y and 105K is rotatably linked with a gear disposed at the external circumference of a revolving gear to maintain its posture constant.

During image formation, the developing unit corresponding to the latent image, i.e., the magenta developing unit 105M in FIG. 6, stands still at a position facing the image bearing member 104*a*, and its developing sleeve 105*b* is positioned so as to face the surface of the image bearing member 104*a* with a small gap.

When a predetermined developing unit, i.e., the magenta developing unit 105M in FIG. 6, is rotatably moved to a developing position, a developing bias voltage is applied to the developing sleeve 105*b* by connecting the developing sleeve 105*b* to a high-voltage power supply of the main body of the printer. At the same time, the developing sleeve 105*b* is coupled with driving means from a driving source to perform predetermined rotation. During development, by applying the developing bias voltage to and rotatably driving the developing sleeve 105*b*, the latent image on the image bearing member 104*a* is developed to provide a visible toner image.

A sheet feeding unit 101 for feeding a transfer material 102 to a tranfer drum 103 includes a sheet feeding cassette 101*a*, for accommodating sheets of the transfer material 102, which is mounted in a base portion of the main body of the printer. During image formation, a sheet feeding roller 101*b* rotates in accordance with an image forming operation to individually separate sheets of the transfer material 102 from within the sheet feeding cassette 101*a* and to feed a separated sheet of the transfer material 102 to the transfer drum 103.

The transfer drum 103 is rotated at substantially the same speed as the circumferential speed of the image bearing member 104*a* (for example, 75.4 mm/sec) (hereinafter termed a "process speed") in order to wind the transfer material 102 fed from the sheet feeding unit 101 therearound and transfer the magenta toner image formed on the image bearing member 104*a* onto the transfer material 102 at a transfer nip.

The transfer drum 103 is configured by forming an elastic layer 103*b*, made of a sponge, rubber or the like, on the outer circumference of an aluminum cylinder 103*a* having a diameter of 180 mm, forming a resistive layer 103*c* on the outer circumference of the elastic layer 103*b*, and forming a dielectric layer 103*d* on the resistive layer 103*c*. A gripper 103*f* for gripping the leading edge of the fed transfer material 102 is provided at a predetermined position on the outer circumference of the transfer drum 103. An electrostatic attracting roller 103*g* is detachably provided so as to face the outer circumference of the transfer drum 103 and to press the transfer material 102 against the outer circumference of the transfer drum 103. By applying a voltage between the electrostatic attracting roller 103*g* and the transfer drum 103, charges are induced on the transfer material 102, which is a dielectric material, and the dielectric layer 103*d* of the transfer drum 103 to electrostatically attract the transfer material 102 onto the outer circumference of the transfer drum 103.

A cleaner 104*d* for cleaning toner particles remaining on the image bearing member 104*a* after transferring the toner image onto the transfer material 102 is disposed in the vicinity of the outer circumference of the image bearing member 104*a* at a portion downstream from the transfer portion.

A fixing unit 106 includes a rotatably driven pressing roller 106*a* and a fixing roller 106*b* for supplying the transfer material 102 with heat and pressure in a state of pressure contact with the pressing roller 106*a*. By passing the transfer material 102 peeled and conveyed from the transfer drum 103 while carrying the toner images of the respective colors through the fixing unit 106, the toner images of the respective colors are fixed.

In an image forming operation, the transfer material 102 within the sheet feeding cassette 101*a* is fed to the transfer drum 103 by the sheet feeding roller 101*b*. The transfer drum 103 grips the leading edge of the fed transfer material 102 with the gripper 103*f* and attracts the transfer material 102 on its circumferential surface.

On the other hand, a magenta image is exposed on the image bearing member 104*a*, whose surface has been uniformly charged by the charging roller 104*b*, by the scanner unit 110*a*, to form a magenta latent image on the outer circumference of the image bearing member 104*a*. The magenta developing unit 105M is driven simultaneously with the formation of the latent image. That is, the magenta latent image formed on the image bearing member 104*a* is developed by applying a developing bias voltage having the same polarity and substantially the same potential as the charging polarity of the image bearing member 104*a* so as to cause a magenta toner to adhere to the latent image to form a magenta toner image on the image bearing member

104*a*. Then, by applying a transfer voltage having a polarity inverse to the polarity of the magenta toner to the transfer drum 103, the magenta toner image on the image bearing member 104*a* is transferred onto the transfer material 102 on the transfer drum 103.

Upon completion of the transfer of the magenta toner image, the cyan developing unit 105C in the next step is rotated and positioned to a developing position facing the image bearing member 104*a*. Latent images for cyan, yellow and black toners are sequentially formed and developed, and obtained toner images are sequentially transferred in the same manner as in the case of the magenta image to form a full-color image on the transfer material 102.

By four rotations of the transfer drum 103 gripping and holding the transfer material 102, a full-color image comprising four colors can be obtained. That is, a full-color image is output in $180\pi\times4/75.4=30$ seconds.

The transfer material 102 after completion of transfer of toner images of four colors is separated from the tranfer drum 103 and is conveyed to the fixing unit 106. After fixing the full-color toner image by the fixing unit 106, the transfer material 102 is discharged onto a discharged-sheet tray 108 by a pair of discharging rollers 107.

In the above-described conventional color laser printer, however, both of a driving gear for the tranfer drum 103 and a driving gear for the image bearing member 104*a* are directly driven by a single driving motor, and the transfer drum 103 and the image bearing member 104*a* are made to be in pressure contact with each other at a transfer nip portion. Hence, the vibration of the motor within the closed-loop driving mechanism is amplified to strongly vibrate the image bearing member 104*a* and the transfer drum 103, resulting in disturbance in the latent image formed by the laser beam or a failure in image transfer.

Such problems also arise in image forming apparatuses in which a toner image on an image bearing member is directly transferred onto an intermediate transfer member and the toner image on the intermediate transfer member is then transferred onto a transfer material.

SUMMARY OF THE INVENTION

It is an object of the present invention to provide an image forming apparatus which can prevent disturbance of an image formed on an image bearing member, or a failure in image transfer.

According to one aspect, the present invention which achieves the above-described object relates to an image forming apparatus including a rotatable image bearing member for bearing an image, a rotatable moving member for forming a transfer nip with the image bearing member in order to tranfer the image on the image bearing member, single driving means, first driving transmission means for transmitting a driving force of the single driving means to the image bearing member, and second driving transmission means for transmitting the driving force of the single driving means to the moving member. The single driving means independently drives the first driving transmission means and the second driving transmission means. The single driving means includes damping means for damping a vibration of the image bearing member or the moving member.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
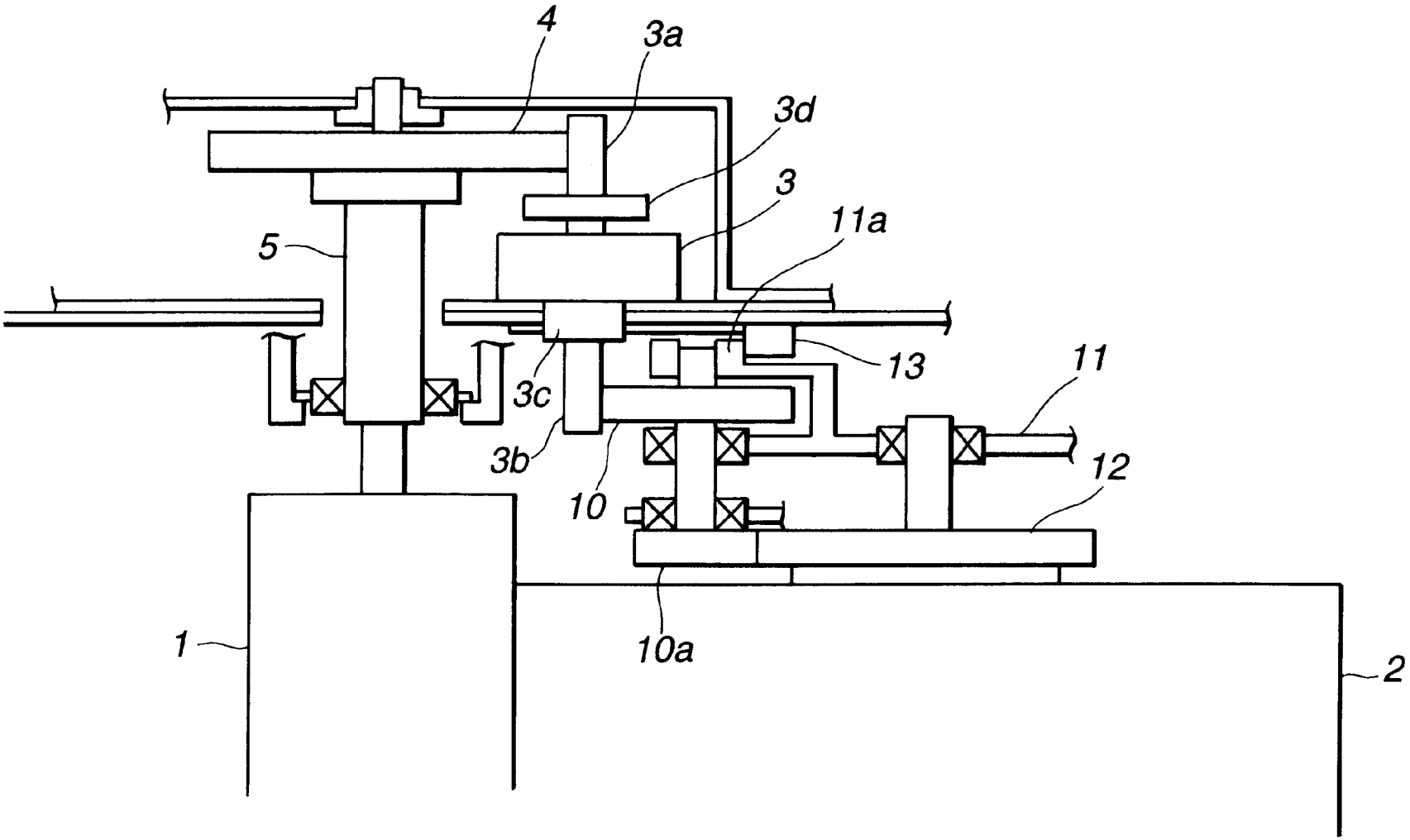
FIG. 1 is a front view of a driving device of an image forming apparatus according to an embodiment of the present invention.
Figure 2:
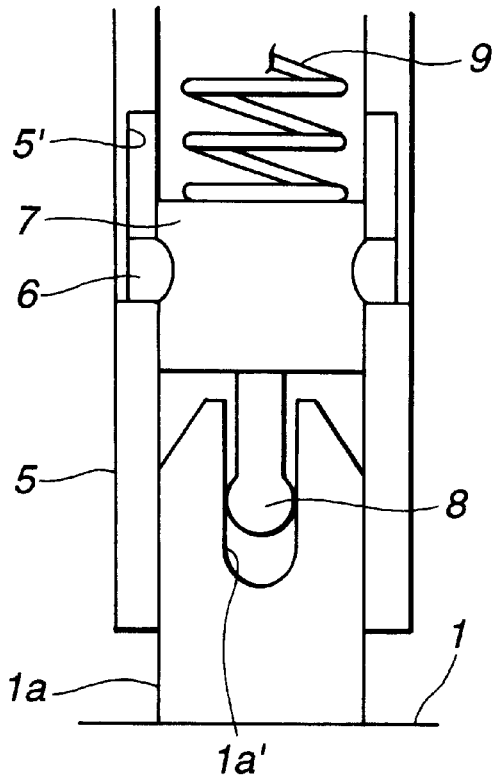
FIG. 2 is an enlarged side cross-sectional view illustrating a part of the driving device shown in FIG. 1.
Figure 3:
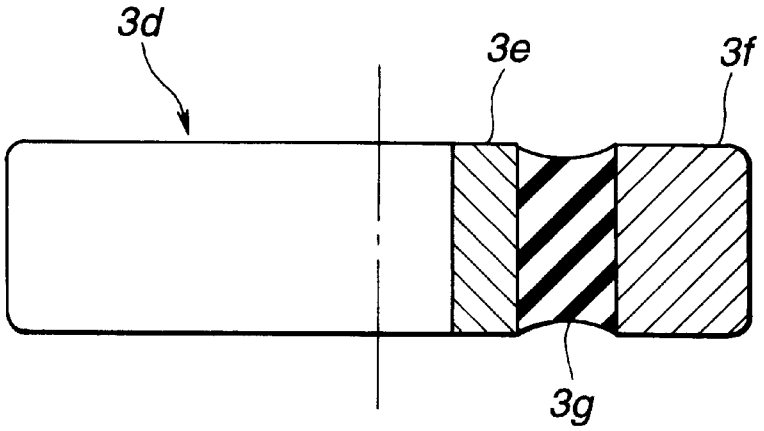
FIG. 3 is a cross-sectional view of a dynamic damper.
Figure 4A:
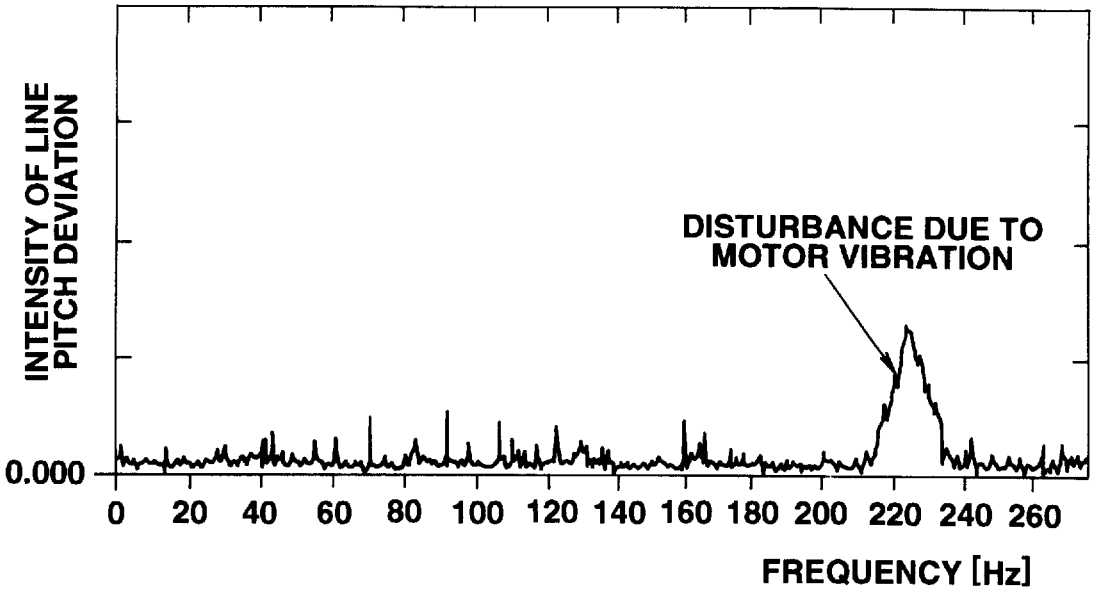
FIGS. 4(*a*) and 4(*b*) are diagrams illustrating the influence of the dynamic damper on the intensity of line pitch deviation of an image.
Figure 4B:
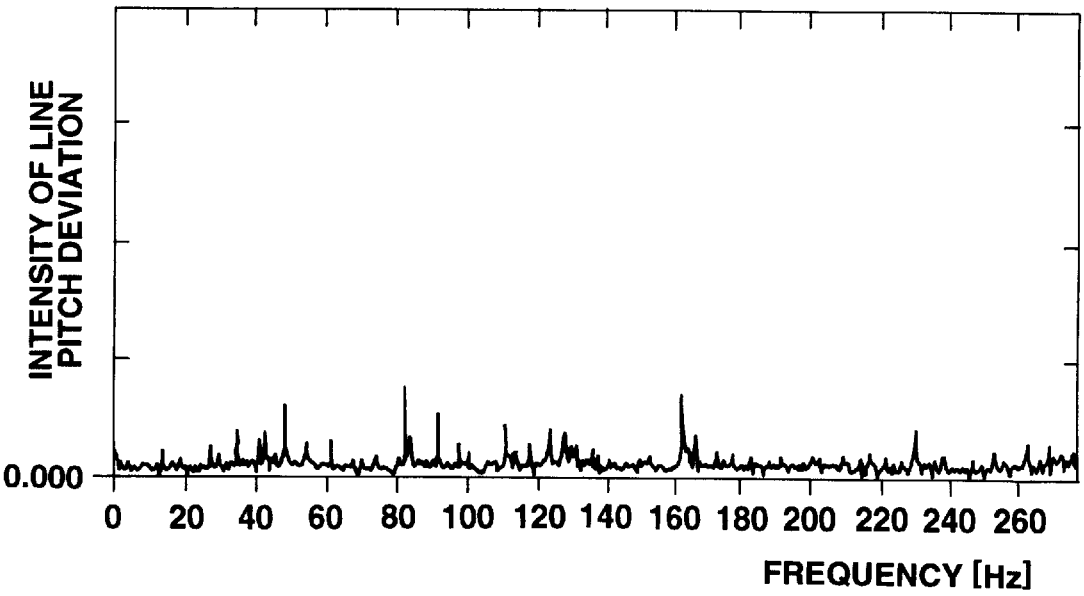
Figure 5:
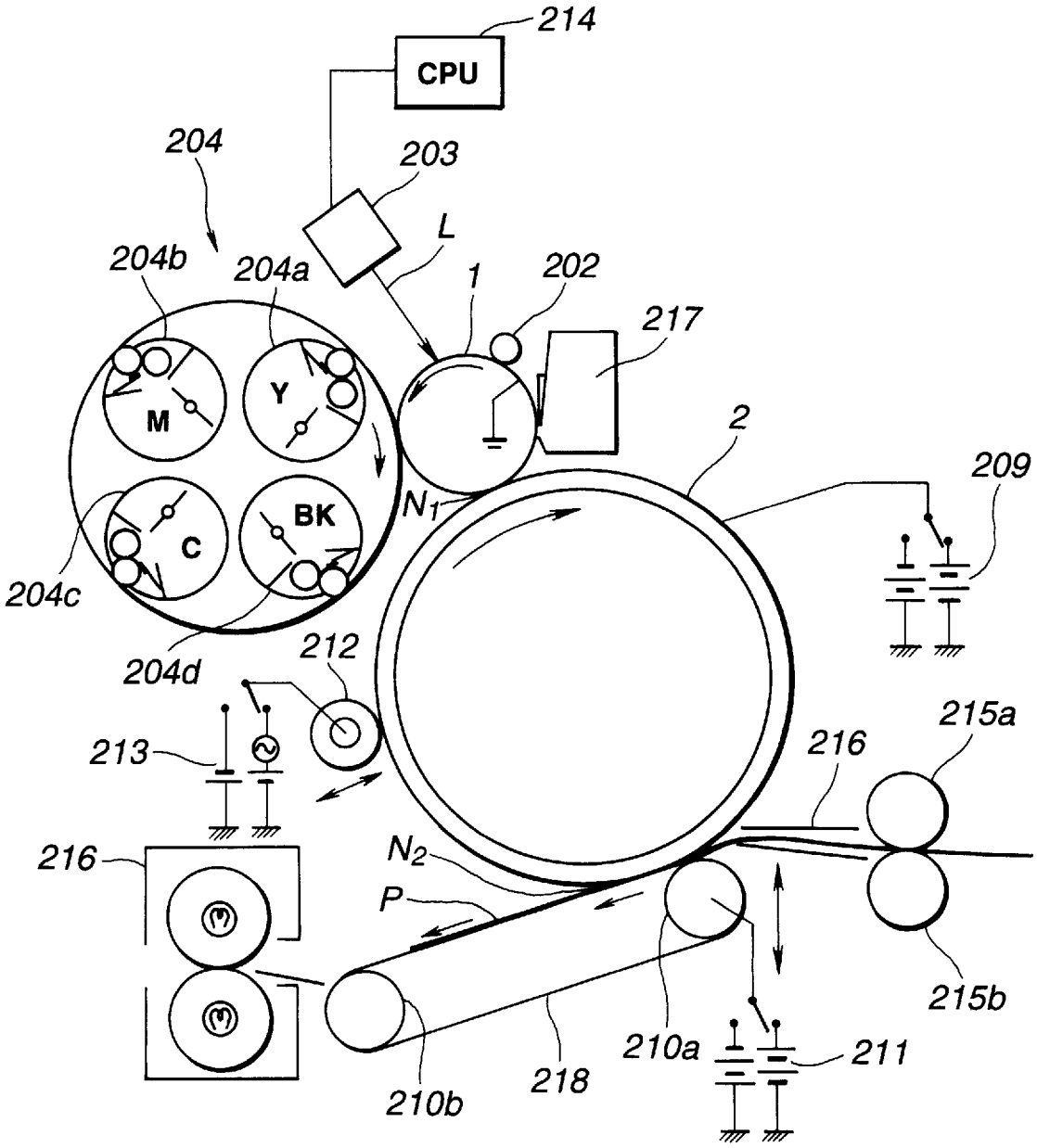
FIG. 5 is a schematic cross-sectional view illustrating the configuration of the image forming apparatus of the embodiment.

FIG. 1 is a front view of a driving device of an image forming apparatus of the embodiment. FIG. 2 is an enlarged side cross-sectional view of the driving apparatus shown in FIG. 1. FIG. 3 is a cross-sectional view of a dynamic damper. FIGS. 4(*a*) and 4(*b*) are diagrams illustrating the influence of the dynamic damper on the intensity of line pitch deviation. FIG. 5 is a schematic diagram ilustrating the configuration of the image forming apparatus of the embodiment.

In FIG. 1, there are shown an image bearing member (photosensitive drum) 1, and an intermediate transfer member 2 serving as a moving member. These members are independently driven by a motor 3, serving as driving means.

A driving gear 4 is fixed to an end portion of a driving shaft 5 of the image bearing member 1. The driving gear 4 meshes with a gear portion 3*a* of the motor 3. A driving force is independently transmitted from the motor 3 to the image bearing member 1 and the intermediate transfer member 2, and the image bearing member 1 and the intermediate transfer member 2 are brought in pressure contact with each other at a transfer nip portion $N_1$. That is, a closed-loop driving mechanism is provided.

Next, an image forming process will be described with reference to FIG. 5.

The surface of the photosensitive drum 1, serving as the image bearing member, is uniformly charged by a primary charger 202, and an electrostatic latent image is formed on the surface of the photosensitive drum 1 by a laser beam L based on image information. The electrostatic latent image is developed, for example, by a developing unit 204C, having a cyan toner, of a developing device 204 to form a cyan toner image on the photosensitive drum 1. The cyan toner image is then subjected to primary image transfer onto the intermediate transfer member 2 at the transfer nip portion $N_1$. At that time, a predetermined voltage is applied from a power supply 209 to the base of the intermediate transfer member 2. By repeating this process up to the primary image transfer for a magenta toner, a yellow toner and a black toner, a full-color image is formed on the intermediate transfer member 2. This full-color toner image is subjected to secondary image transfer onto a transfer material P fed by a pair of registration rollers 215*a* and 215*b* at a transfer nip portion $N_2$. At that time, a predetermined voltage is applied from a power supply 211 to a roller 210*a* of a secondary transfer belt 218. The transfer material P having the full-color toner image tranferred thereon is conveyed to a fixing device 216 by the secondary transfer belt 218, and the full-color image is fixed on the tranfer material P by being pressed and heated by the fixing device 216. The transfer material P is then discharged to the outside of the apparatus, and a series of image forming processes is terminated.

Toner particles remaining on the intermediate transfer member 2 after the secondary transfer are charged by a charging roller 212 to a polarity opposite to the normal polarity of the toner within the developing device 204, and are subjected to reverse transfer onto the image bearing member 1 at the transfer nip portion $N_1$. At that time, a predetermined voltage is applied from the power supply 209. The toner particles which have remained after the image tranfer and have been subjected to reverse transfer onto the image bearing member 1 are recollected by a cleaning device 217 for the image bearing member 1. When consecutively forming images, by performing primary transfer of the next image simultaneously with the above-described reverse transfer of the remaining toner particles, it is possible to improve the throughput of image formation.

As shown in FIG. 2, the driving shaft 5 of the image bearing member 1 is hollow, and a top 7 is fitted within the driving shaft 5 so as to be slidable in axial directions (vertical directions in FIG. 2). The top 7 is slidably fitted in a coupling la provided at a side portion of the image bearing member 1, and transmits a driving force in the direction of rotation. A pin 6 is threaded through the top 7 in a direction orthogonal to the driving shaft 5. Both ends of the pin 6 are fitted in a long groove 5', which is long in the axial direction, formed in an inner circumferential portion of the driving shaft 5. Accordingly, the top 7 is slidable in axial directions within a range in which the pin 6 can move within the long groove 5'.

A spring 9 contacts the back surface of the top 7 in order to retract the top 7 when the coupling 1*a* is inserted into the driving shaft 5 at a position different from a fitting position (i.e., when the angular position of the top 7 does not coincide with the angular position of the coupling 1*a*), and to couple the top 7 with the coupling 1*a* when the coupling 1*a* is rotated to the fitting position (i.e., when the angular position of the top 7 coincides with the angular position of the coupling 1*a*)

That is, the spring 9 presses the top 7 against the coupling 1*a*. More specifically, the coupling 1*a* has a cut portion 1*a'* having a U-shaped cross section, and the top 7 has a projection 8 for engaging with the cut portion 1*a'*. The width of the projection 8 is larger than the width of the cut portion 1*a'* of the coupling 1*a* in a direction perpendicular to the plane of FIG. 2. Accordingly, the coupling 1*a* is fitted to the top 7 every time the coupling 1*a* rotates by 180° C. FIG. 1 illustrates a state in which the top 7 is fitted in the coupling 1*a*.

As shown in FIG. 1, the motor 3, serving as driving means, has another gear portion 3*b*, serving as a driving shaft, at a side opposite to the gear portion 3*a*, serving as a driving shaft. These gear portions 3*a* and 3*b* are fixed with respect to the direction of rotation, so that the relative position between the gear portions 3*a* and 3*b* does not change. Although in the first embodiment, the gear portions 3*a* and 3*b* are the same members, a pinion may be used instead of the gear portion, and the gear portions 3*a* and 3*b* do not necessarily have the same specifications. Alternatively, a relatively long driving shaft may be provided only at one end of the motor 3, and the image bearing member 1 and the intermediate transfer member 2 may be independently driven. In another approach, a predetermined gear train may be engaged with a driving shaft provided only at one end of the motor 3, so that the driving force branches to the image bearing member 1 and the intermediate transfer member 2.

An idler gear 10 is rotatably held on a holding box 11 of the intermediate transfer member 2, and an idler gear 10*a* is fixed on the shaft of the idler gear 10. The gear 10*a* rotatably drives the intermediate transfer member 2 by meshing with a driving gear 12 of the intermediate transfer member 2. A ring-shaped projection 11*a*, which serves as the center of rotation when the intermediate transfer member 2 swings and contacts the image bearing member 1, is at the same concentric position as the idler gear 10, and is held by a holding fixed plate 13 threaded and positioned by a positioning projection 3*c* of the motor 3, so that the center distance between the gear portion 3*b* and the idler gear 10 is very precisely maintained.

The motor 3 has bearings (not shown) at both ends of the inside. By disposing the motor 3 between the driving gear 4 of the image bearing member 1 and the driving gear 12 of the intermediate transfer member 2, it is possible to provide a very rigid driving device, compared with the case of providing a driving shaft only at one end of the motor 3 and independently driving the image bearing member 1 and the intermediate transfer member 2. Furthermore, since the gears are provided at both sides of the motor 3, it is possible to easily install the apparatus and to reduce the size of the apparatus.

In this embodiment, a dynamic damper 3*d* is provided at the motor 3 so as to be coaxial with the the gear portions 3*a* and 3*b*. Since the dynamic damper 3*d* is provided coaxially with the gear portions 3*a* and 3*b*, resonance by the motor 3 can be effectively cancelled.

As shown in FIG. 3, the dynamic damper 3*d* is configured by providing an elastic member 3*g*, made of rubber or the like, between a collar portion 3*e* fitted with the motor shaft, and an outer ring portion 3*f*.

In the driving device having the above-described configuration, the revolution of the motor 3 is transmitted to the image bearing member 1 by being decelerated through the gear portion 3*a* and the driving gear 4, as well as to the intermediate transfer member 2 by being decelerated in two steps through the gear portion 3*b* and the idler gear 10, and the gear 10*a* and the driving gear 12, so that the image bearing member 1 and the intermediate transfer member 2 are rotatably driven at predetermined speeds.

In this embodiment, since the dynamic damper 3*d* is provided coaxially with the gear portions 3*a* and 3*b*, amplification of vibration due to the resonance of the motor 3, which is peculiar in a closed-loop driving mechanism as the one described above, is suppressed by the damping effect of the dynamic damper 3*d*. As a result, the vibration of the image bearing member 1 and the intermediate rotating member 2 is suppressed, and the generation of disturbance in the latent image formed on the surface of the image bearing member 1 is effectively prevented. It is also possible to prevent a failure in the transfer of the toner image from the image bearing member 1 to the intermediate transfer member 2, and from the intermediate transfer medium 2 to the transfer material. FIG. 4(*a*) illustrates the intensity of line pitch deviation when the dynamic damper 3*d* is not provided, and FIG. 4(*b*) illustrates the intensity of line pitch deviation when the dynamic dampler 3*d* is provided. It can be understood from FIGS. 4(*a*) and 4(*b*) that, while disturbance due to the vibration of the motor is generated when the dynamic damper 3*d* is not provided, no such disturbance occurs when the dynamic damper 3*d* is provided as in the embodiment.

The graphs illustrating the relationship between the intensity of line pitch deviation and the frequency shown in FIGS. 4(*a*) and 4(*b*) were obtained in the following procedures.

(1) A toner image for a test pattern (for example, a toner image comprising lines separated from each other by 0.2 mm in the direction of rotation of the image bearing member 1) was formed on the image bearing member 1. The toner image was transferred onto the intermediate transfer member 2, and the toner image on the intemediate transfer member 2 was further transferred onto a transfer material (in the case of using a transfer-material bearing member (transfer drum) instead of the intermediate transfer member, the toner image for the test pattern on the image bearing member 1 is transferred onto the transfer material).

(2) Deviation from an ideal position for each of the lines in the toner image for the test pattern on the transfer material was measured.

(3) The amount of deviation of the line from the ideal position was input to a FFT (fast Fourier transform) analyzer, which performed frequency analysis to provide the graphs shown in FIGS. 4(*a*) and 4(*b*).

Although in this embodiment, the dynamic damper 3*d* is provided at the gear portion 3*a* for driving the image bearing member 1, the same effects may be obtained even if the dynamic damper 3*d* is provided at the gear portion 3*b* for driving the intermediate transfer member 2. The same effects may also be obtained by providing a flywheel at the position of the dynamic damper 3*d* instead of the dynamic damper 3*d* in order to prevent resonance.

As described above, according to the present invention, since the amplification of vibration due to the resonance of the motor is suppressed by the damping effect of the dynamic damper or the flywheel provided on the shaft of the motor, it is possible to suppress the vibration of the image bearing member, to effectively suppress the generation of disturbance in a latent image formed on the surface of the image bearing member, and to prevent a failure in the transfer of a toner image from the image bearing member to the moving member, or to a transfer material borne on the moving member.

Figure 6:
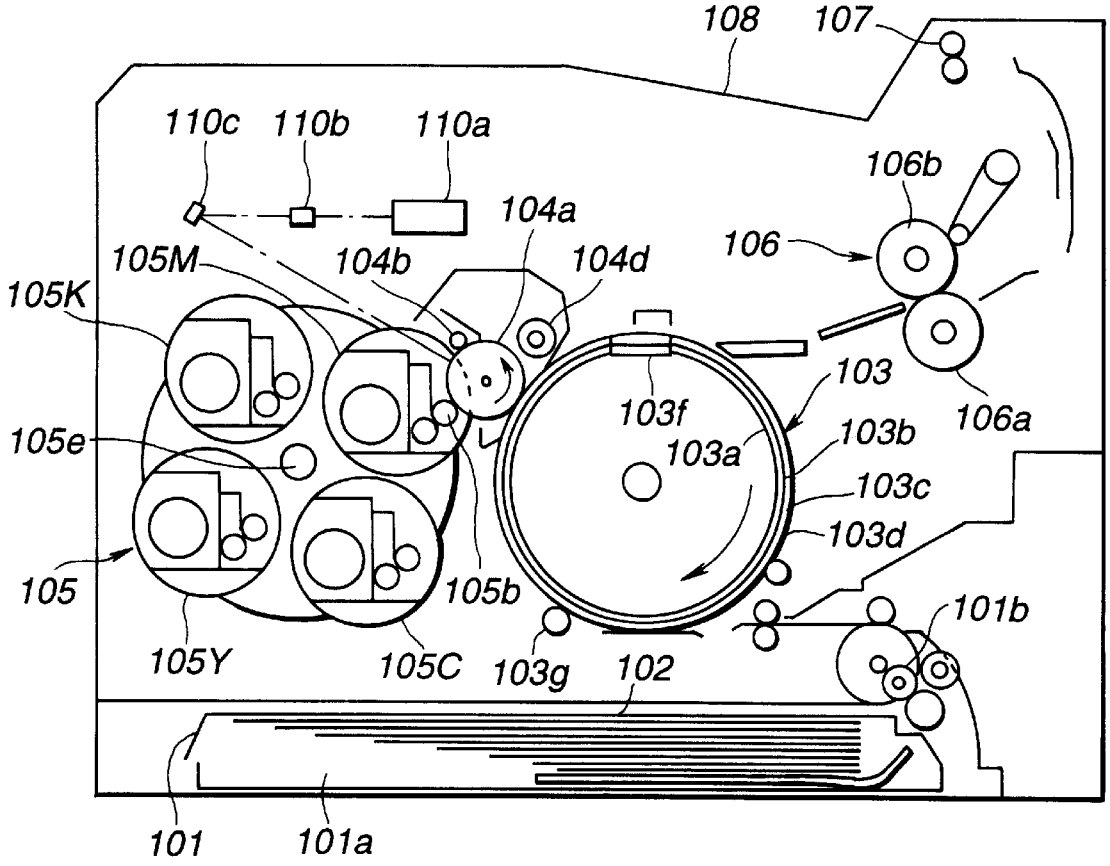
FIG.6 PRIOR ART
FIG. 6 is a schematic cross-sectional view of a conventional color laser printer.

Although in the present invention, a description has been provided illustrating the intermediate transfer member 2 as the moving member, the invention is not limited to such a case. For example, the present invention may also be applied to an image forming apparatus including a transfer drum as a transfer-material bearing member for performing multiplex transfer at a transfer nip by attracting a transfer material, as shown in FIG. 6.

At that time, of course, as shown in FIG. 1, the image bearing member 1 and the transfer drum 2 are independently driven by the single motor 3, and the image bearing member 1 and the transfer drum 2 are brought into pressure contact with each other. That is, as in the embodiment, a closed-loop driving mechanism is provided.

However, the present invention is more suitably applied to an image forming apparatus including an intermediate transfer member for performing two-step transfer (primary transfer and secondary transfer) until an image on an image bearing member is formed on a transfer material.

The individual components shown in outline in the drawings are all well-known in the image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a rotatable image bearing member for bearing an image;

a rotatable moving member for forming a transfer nip with said image bearing member in order to transfer the image on said image bearing member;

single driving means;

first driving transmission means for transmitting a driving force of said single driving means to said image bearing member; and second driving transmission means for transmitting the driving force of said single driving means to said moving member;

wherein said first driving transmission means and said second driving transmission means receive the driving force independently of one another, and wherein said single driving means comprises damping means for damping a vibration of said image bearing member or said moving member.

2. An image forming apparatus according to claim 1, wherein said single driving means comprises a driving shaft, and wherein said first driving transmission means and said second driving transmission means engage with said driving shaft.

3. An image forming apparatus according to claim 2, wherein said damping means is provided on said driving shaft.

4. An image forming apparatus according to claim 1, wherein said single driving means comprises driving shafts at both ends thereof, and wherein said first driving transmission means and said second driving transmission means engage with a corresponding one of said driving shafts.

5. An image forming apparatus according to claim 4, wherein said damping means is provided on said driving shaft.

6. An image forming apparatus according to any one of claims 1 through 5, wherein said damping means comprises a dynamic damper.

7. An image forming apparatus according to any one of claims 1 through 5, further comprising image forming means for forming the image on said image bearing member.

8. An image forming apparatus according to claim 7, wherein said image forming means comprises charging means for charging said image bearing member, and exposure means for exposing said image bearing member after the charging, and wherein an electrostatic image is formed on said image bearing member by said charging means and said exposure means.

9. An image forming apparatus according to any one of claims 1 through 5, wherein said moving member comprises an intermediate transfer member onto which the image on said image bearing member is transferred at the transfer nip, and wherein the image on said intermediate transfer member is transferred onto a transfer material.

10. An image forming apparatus according to claim 9, wherein said image bearing member can bear images of a plurality of colors, wherein the images of the plurality of colors on said image bearing member are sequentially transferred onto said intermediate transfer member by being superposed at the transfer nip, and wherein the images of the plurality of colors on said intermediate transfer member are transferred onto the transfer material.

11. An image forming apparatus according to any one of claims 1 through 5, wherein said moving member comprises a transfer-material bearing member for bearing a transfer material, and wherein the image on said image bearing member is transferred onto the transfer material borne on said transfer-material bearing member at the transfer nip.

12. An image forming apparatus according to claim 11, wherein said image bearing member can bear images of a plurality of colors, and wherein the images of the plurality of colors on said image bearing member are sequentially transferred onto the transfer material borne on said transfer-material bearing member by being superposed at the transfer nip.

* * * * *

UNITED STATES PATENT AND TRADEMARK OFFICE

CERTIFICATE OF CORRECTION

PATENT NO. : 6,055,399

DATED : April 25, 2000

INVENTOR(S) : KINYA OMURA

It is certified that error appears in the above-identified patent and that said Letters Patent is hereby corrected as shown below:

COLUMN 1:
Line 65, "tranfer" should read --transfer--.

COLUMN 3:
Line 18, "tranfer" should read --transfer--;
Line 24, "tranfer" should read --transfer--; and
Line 49, "tranfer" should read --transfer--.

COLUMN 4:
Line 67, "tranfer" should read --transfer--.

COLUMN 5:
Line 13, "tranfer" should read --transfer--

UNITED STATES PATENT AND TRADEMARK OFFICE

CERTIFICATE OF CORRECTION

PATENT NO. : 6,055,399

DATED : April 25, 2000

INVENTOR(S) : KINYA OMURA

It is certified that error appears in the above-identified patent and that said Letters Patent is hereby corrected as shown below:

COLUMN 6:

Line 52, "rotating" should read --transfer--;
Line 58, "medium 2" should read --member 2--; and
Line 62, "dampler 3d" should read --damper 3d--.

COLUMN 7:

Line 9, "intemediate" should read --intermediate--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*